United States Patent [19]

Masuyama et al.

[11] Patent Number: 4,957,701

[45] Date of Patent: Sep. 18, 1990

[54] HIGH-STRENGTH HIGH-CR FERRITIC HEAT-RESISTANT STEEL

[75] Inventors: Fujimitsu Masuyama; Takashi Daikoku, both of Nagasaki; Hisao Haneda, Tokyo; Kunihiko Yoshikama, Amagasaki; Hiroshi Teranishi, Amagasaki; Atsuro Iseda, Amagasaki, all of Japan

[73] Assignees: Sumitomo Metal Industries, Ltd., Osaka; Mitsubishi Jukogyo Kabushiki Kaisha, Tokyo, both of Japan

[21] Appl. No.: 232,227

[22] Filed: Aug. 15, 1988

Related U.S. Application Data

[62] Division of Ser. No. 917,502, Oct. 10, 1986, Pat. No. 4,799,972.

[30] Foreign Application Priority Data

Oct. 14, 1985 [JP] Japan ..... 60-226993
Oct. 14, 1985 [JP] Japan ..... 60-226994

[51] Int. Cl.[5] ..... C22C 38/22; C22C 38/26; C22C 38/24

[52] U.S. Cl. ..... 420/69; 420/68; 420/110; 420/111

[58] Field of Search ..... 420/64, 66, 67, 68, 420/69, 105, 106, 110, 111

[56] References Cited

FOREIGN PATENT DOCUMENTS 56-96056 8/1981 Japan ..... 420/69
58-181849 10/1983 Japan .
60-165359 8/1985 Japan ..... 420/69

*Primary Examiner*—Deborah Yee
*Attorney, Agent, or Firm*—Burns, Doane, Swecker & Mathis

[57] ABSTRACT

A high-strength high-Cr ferritic, heat-resistant steel exhibiting improved high-temperature, long-term creep strength and a process for producing the same are disclosed. The steel consists essentially of, by weight %:

| | |
|---|---|
| C: not more than 0.2%, | Si: not more than 1.0%, |
| Mn: 0.1–1.5%, | P: not more than 0.03%, |
| S: not more than 0.03%, | Ni: not more than 1.0%, |
| Cr: 5.0–15%, | Mo: 0.02–3.0%, |
| W: not more than 4.0%, | sol. Al: 0.05–0.04%, |
| N: not more than 0.07%, | |

at least one of V: 0.01–0.4% and Nb: 0.01–0.3%, B: 0–0.02%, at least one of Ca, Ti, Zr, Y, La, and Ce: 0–0.2%, and the balance Fe and incidental impurities, $A_{cl}$ point defined by Formula (1) below being 820 or higher.

$$A_{c1}\,(°C.) = 765 - 500C - 450N + 30Si - 25Mn + 25Mo + 15W + 11Cr + 50V + 30Nb - 30Ni + 30\,\text{sol. Al}(\text{weight }\%).$$

3 Claims, 4 Drawing Sheets

HIGH-STRENGTH HIGH-CR FERRITIC HEAT-RESISTANT STEEL

This application is a divisional of application Ser. No. 06/917,502, filed Oct. 10, 1986, now U.S. Pat. No. 4,799,972.

The present invention relates to a high-Cr ferritic, resistant steel with improved high temperature properties, the steel being suitable for products such as steam generators, boilers, and the like which must resist high temperatures and pressures. The steel is advantageously used at a temperature of 600° C. or higher.

The present invention is also directed to a process for producing the above-described steel, the method including special heat treatment which gives the steel improved creep strength at elevated temperatures for long periods of time.

In recent years, the size and working pressures of high-temperature apparatuses of the types mentioned above have been increasing so as to achieve higher thermal efficiency. As a result, materials having improved high temperature, long-term creep strength are required for these apparatuses. Namely, since these heat-resistant steels are used for manufacturing super heater tubes and reheater tubes for boilers, as well as heat exchangers for nuclear power and chemical plants, they must possess improved formability and weldability in addition to high-temperature strength, hot corrosion and oxidation resistance, and toughness.

Recently, it is the trend in the manufacture of high-temperature, high-pressure boilers to employ a high-Cr ferritic steel as a heat-resistant steel member for use at 550°-650° C. in order to enable an increase in service temperatures and a decrease in material costs. Therefore, there is a demand for a steel having markedly improved high-temperature properties, e.g. creep strength at 550°-650° C. for $10^5$ hours. Usually, high-temperature, high-pressure boilers are designed taking into consideration an allowable stress calculated on the basis of creep strength at an elevated temperature after $10^5$ hours. The below-mentioned steel of DIN X 20CrMo W V 121 exhibits 6.2 kgf/mm$^2$ at 600° C. after $10^5$ hours.

The following steels are appropriate for such uses: (i) austenitic stainless steels, (ii) low-alloy steels such as 2 ¼Cr-1Mo steel, and (iii) high-Cr ferritic steels such as 9Cr-1Mo steel. Among these steels, high-Cr ferritic steels possess the advantages that they are much superior to low-alloy steels concerning the resistant to hot corrosion and oxidation and that they exhibit excellent thermal conductivity and stress-corrosion resistance in comparing with those of austenitic stainless steels. Furthermore, high-Cr ferritic steels are less expensive than austenitic stainless steels.

Furthermore, this type of steel has a high Cr content so as to further improve the resistance to oxidation. It can be advantageously used as a heat-resistant structural member at a high temperature in place of low-alloy steels, which cannot be used at temperatures higher than 600° C. Several well-known high-Cr ferritic steels exhibiting improved high-temperature strength are 9Cr-1Mo steel (STBA 26), a newly-developed 9Cr steel (ASTM A213 T91), and 12Cr-1Mo steel (DIN X 20CrMo W V 121).

These high-Cr ferritic steels are of the precipitation hardenable type. However, such high-Cr ferritic steels containing precipitation hardening elements such as V, and Nb exhibit a rapid decrease in creep strength at a temperature higher than 600° C.

In general, high strength ferritic steel is usually subjected to normalizing and tempering when it is heat treated. When the steel is to be used for a heat exchanger, and the like, the tempering is carried out at a temperature which is at most 30°-50° C. lower than the $A_{c1}$ point, but higher than the service temperature. This heat treatment is carried out for achieving a stable metallurgical structure of tempered martensite to further improve high-temperature, long-term creep strength. When the tempering temperature is lower than the above-mentioned range, the creep strength increases for a short period, but after a certain length of time, the structure is recrystallized at high temperatures, and a rapid decrease in strength takes place.

In order to stabilize the high-temperature strength of 12Cr steels, it is desirable that the tempering temperature be 800° C. or higher. However, the $A_{c1}$ point of conventional steel is about 800° C., and in an actual production line the temperature of a heating furnace fluctuates to some extent. Therefore, it is practically impossible to carry out tempering at a temperature higher than 800° C..

The addition of an austenite former element, such as C, Mn, Ni, and N decreases the $A_{c1}$ point, but it is conventional to intentionally add such elements so as to suppress the formation of delta-ferrite. The formation of a large amount of delta-ferrite is not desirable with regards to strength and toughness, although the presence of a small amount of delta-ferrite is allowable.

On the other hand, when an alloy steel is designed, the $A_{c1}$ point is not taken into account at all.

Japanese Patent Application Laid-Open Specification No.110758/1980 discloses Cr-steels for use at high temperatures. However, neither the the $A_{c1}$ point nor the criticality thereof are referred to therein. Further, it defines the amount of Al as being not more than 0.02% by weight, but the Al is referred to as an impurity. The creep strength of the resulting steel is rather low, i.e., under conditions of 650° C.×9 kgf/mm$^2$ rupture takes place after only 1400 hours.

Japanese Patent Publication No. 36341/1982 discloses the same type of Cr-steels. However, this reference does not mention anything about the $A_{c1}$ point, either.

JPA Laid-Open Specification No. 181849/1983 teaches the combination of Al-deoxidation and Nb addition. However, this reference does not mention anything about the $A_{c1}$ point and importance thereof in obtaining a steel which can resist conditions of 650° C.×8 kgf/mm$^2$ for 2600 hours or more.

SUMMARY OF THE INVENTION

An object of the present invention is to provide a high-Cr ferritic, heat-resistant steel which exhibits improved high-temperature, long-term creep strength, e.g., a ferritic steel which exhibits creep strength higher than that of the conventional steel, e.g., 6.2 kgf/mm$^2$ of DIN X 20CrMo W V 121 at a temperature of 600° C. or higher after $10^5$ hours. In an accelerated creep test carried out under conditions of 650° C. X 8 kgf/mm$^2$ such creep strength corresponds to a creep rupture time of over 2600 hours.

Thus, another object of the present invention is to provide a high-Cr ferritic, heat-resistant steel with improved high-temperature, long-term creep strength, which can resist a stress of 8 kgf/mm$^2$ at 650° C. for over 2600 hours.

The inventors of the present invention found that a particular steel composition whose $A_{c1}$ point is rather high, i.e., 820° C. or higher can achieve such improved high temperature properties. The steel whose $A_{c1}$ point is rather high can be subjected to high-temperature tempering, the high-temperature strength thereof being the same as that of a conventional steel. The high-temperature tempering is carried out taking into account a service temperature of 600° C. or higher.

Thus, the present invention is a high-strength high-Cr ferritic, heat-resistant steel exhibiting improved high-temperature, long-term creep strength, which consists essentially of, by weight %:

| | |
|---|---|
| C: not more than 0.2%, | Si: not more than 1.0%, |
| Mn: 0.1–1.5%, | P: not more than 0.03%, |
| S: not more than 0.03%, | Ni: not more than 1.0%, |
| Cr: 5.0–15%, | Mo: 0.02–3.0%, |
| W: not more than 4.0%, | sol. Al: 0.05–0.04%, |
| N: not more than 0.07%, | |

at least one of V : 0.01–0.4% and Nb: 0.01–0.3%,

B : 0–0.02%, at least one of Ca, Ti, Zr, Y, La, and Ce : 0–0.2%, and the balance Fe and incidental impurities, the $A_{c1}$ point defined by Formula (1) below being 820° C. or higher.

$$A_{c1}(^\circ C.) = 765 - 500C - 450N + 30Si - 25Mn + 25Mo + 15W + 11Cr + 50V + 30Nb - 30Ni + 30\ \text{sol. Al(weight \%)} \quad (1)$$

In another aspect, the present invention is a process for producing a high-strength high-Cr ferritic, heat-resistant steel exhibiting improved high-temperature, long-term creep strength, which comprises subjecting the steel having the above-mentioned composition to normalizing at a temperature of the $A_{c3}$ point thereof or higher, and then to tempering at a temperature of 810° C. or higher but not higher than the $A_{c1}$ point. In a preferred embodiment, the steel consists essentially of, by weight %:

| | |
|---|---|
| C: 0.05–0.15% | Si: not more than 1.0% |
| Mn: 0.2–1.0% | P: not more than 0.025% |
| S: not more than 0.015%, | Ni: not more than 0.8% |
| Cr: 8.0–13%, | Mo: 0.5–3%, |
| W: 0.5–3.0%, | sol. Al: 0.005–0.04%, |
| N: 0.003–0.07%, | V: 0.1–0.4%, |
| Nb: 0.01–0.2%, | |
| B: 0–0.02%, | |

at least one of Ca, Ti, Zr, Y, La, and Ce : 0–0.2%, and the balance Fe and incidental impurities, the $A_{c1}$ point defined by Formula (1) below being 850° C. or higher, and the Cr-equivalent defined by Formula (2) below being 17 or less.

$$A_{c1}(^\circ C.) = 765 - 500C - 450N + 30Si - 25Mn + 25Mo + 15W + 11Cr + 50V + 30Nb - 30Ni + 30\ \text{sol. Al(weight \%)} \quad (1)$$

$$\text{Cr-equivalent} = Cr - 40C - 30N + 6Si - 2Mn + 4Mo + 1.5W + 11V + 5Nb - 4Ni + 12\ \text{sol. Al} \quad (2)$$

DETAILED DESCRIPTIONS OF THE PREFERRED EMBODIMENTS

Figure 1:
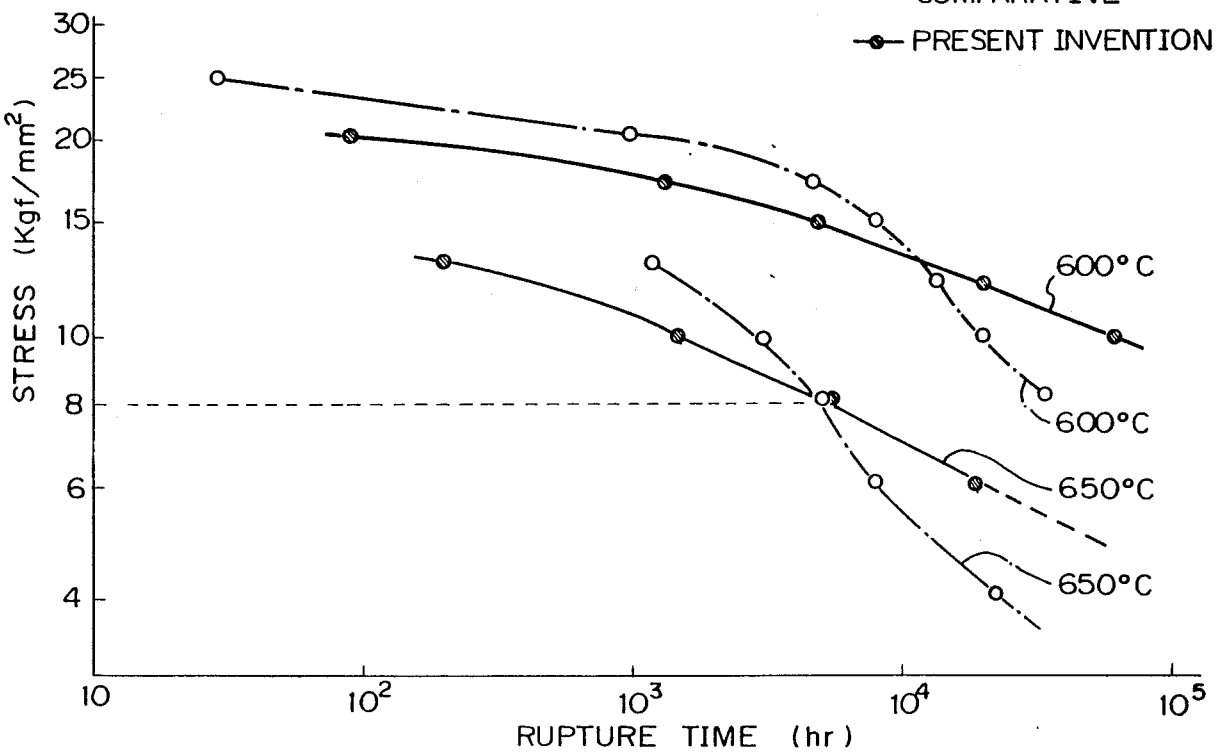
FIG. 1 is a graph comparing the high-temperature strength of the steel of the present invention with that of a comparative one.

One of the features of the present invention is a steel composition which takes into account the $A_{c1}$ point, which is never taken into consideration in the prior art in designing an alloy steel.

Formula (1) which was mentioned above was obtained on the basis of series of experiments carried out by the present inventors.

According to the present invention, the $A_{c1}$ point is defined as being not lower than 820° C., and preferably not lower than 850° C. so as to suppress the gamma transformation as well as to carry out high-temperature tempering at 800° C. or higher, usually 810° C. or higher. A fluctuation in temperature in the course of heat treatment is also taken into account.

The Cr-equivalent mentioned before is defined so as to restrict the amount of delta-ferrite. Sometimes the amount of delta-ferrite increases even for a steel composition whose $A_{c1}$ point is defined as being 850° C. or higher. When the amount of delta-ferrite is moderate, the weldability as well as formability are improved sutstantially. However, when the amount of delta-ferrite is large, the strength and toughness are impaired. Therefore, the Cr-equivalent is preferably 17 or lower so as to provide a steel with high strength and toughness as well as good formability and weldability.

The steel composition of the present invention is preferably restricted to a particular one for the following reasons.

C (Carbon)

Carbon combines with Cr, Mo, W, V, and Nb to form a carbide, resulting in improved high-temperature creep strength. When the carbon content is less than 0.05%, the structure is ferritic, degrading toughness and strength to some extent. On the other hand, when the carbon content is over 0.2%, and sometimes when it is over 0.15%, the $A_{c1}$ point decreases markedly, and it is impossible to carry out tempering at a temperature of 810° C. or higher. In addition, an increase in the amount of carbide renders the steel hard, degrading formability and weldability. According to the present invention the carbon content is defined as being not more than 0.2%, and preferably 0.05–0.15% by weight.

Si (Si)

Silicon is added as a deoxidizing agent. Si is also able to improve the resistance to steam oxidation. However, when the Si content is over 1%, the toughness is impaired, and the creep strength is adversely affected. Thus, according to the present invention, the Si content is restricted to 1% or less.

Mn (Manganese)

The addition of Mn is effective not only to improve hot formability but also to stabilize impurities such as P and S. When the Mn content is less than 0.1%, and usually when it is less than 0.2%, no substantial effect is obtained. However when the Mn content is over 1.5%, and usually when it is over 1%, a hardened phase is formed, impairing toughness. The manganese content is therefore defined as 0.1–1.5%, and preferably 0.2–1.0%.

P, S (Phosphorus, Sulfur)

These elements are impurities adversely affecting toughness, formability, and weldability. Since they are unavoidable, the upper limit thereof is restricted to 0.03%, and preferably to 0.025% for P, and to 0.03%, and preferably to 0.015% for S.

Ni (Nickel)

Nickel is an austenite former and is effective to stabilize martensite structure. However, when the Ni content is over 1.0%, and usually when it is over 0.8%, the creep strength is lowered. Thus, the Ni content is restricted to 1.0% or less, and preferably 0.8% or less.

Cr (Chromium)

Chromium is an essential element for giving the steel a satisfactory level of hot corrosion and oxidation resistance. When the chromium content is less than 5.0%, and usually when it is less than 8.0%, a satisfactory level of oxidation resistance cannot be obtained. On the other hand, when the Cr content is over 15%, and usually when it is over 13%, the amount of delta-ferrite increases to impair strength and toughness. According to the present invention the chromium content is restricted to 5–15%, and preferably 8–13%.

Mo (Molybdenum)

Molybedenum is an element effective for achieving solution strengthening which improves creep strength. However when the Mo content is less than 0.02%, and sometimes when it is less than 0.5%, the intended effect cannot be expected. When the Mo content is over 3%, a large amount of an intermetallic compound will precipitate at an elevated temperature and not only toughness but also strength will deteriorate. The Mo content is defined as 0.02–3.0%, and preferably 0.5–3.0% by weight.

W (Tungsten)

Like Mo, tungsten is an effective solution strengthening element to improve creep strength. When the W content is over 4.0%, and usually when it is over 3%, the effect thereof will saturate. However, when the W content is less than 0.5%, the intended effect cannot be expected. Thus, in the present invention the W content is defined as being not more than 4.0%, and preferably 0.5–3.0%. The atomic size of W is larger than that of Mo, and the diffusion rate of W is slow. Therefore, the addition of W is effective to achieve solution hardening. Further, W is dissolved into a carbide to suppress coarsening of carbides and recrystallizing of tempered martensite during services at high temperatures.

sol. Al (Aluminum)

Aluminum is added as an deoxidizing agent. However, when Al is added in an amount of over 0.04%, the high-temperature creep strength is deteriorated. On the other hand, when the amount of sol. Al is less than 0.005%, the degree of deoxidation is insufficient to ensure the desired level of strength and toughness. In addition, upon welding the material is affected adversely. Thus, according to the present invention, strength and toughness can be maintained at a satisfactory level by restricting the amount of sol. Al to 0.005–0.040% by weight.

N (Nitrogen)

Nitrogen combines with V and Nb to form carbo-, nitrides, the formation of which is effective to improve creep strength. When the amount of added N is over 0.07%, the formability as well as weldability are degraded. On the other hand, when N is added in an amount of less than 0.003%, the intended effect cannot be expected. Thus, according to the present invention the nitrogen content is restricted to not more than 0.07%, and preferably 0.003–0.07%.

V (Vanadium)

V combines with C and N to form finely dispersed precipitates such as V(C,N), which are stable at high temperatures for an extended period of time. The dispersed V(C,N) is significantly effective to improve long-term creep strength. When the V content is less than 0.1%, the intended effect cannot be obtained. On the other hand, when the V content is over 0.4%, creep strength is rather impaired. Thus, the V content is defined as being 0.1–0.4%, and preferably 0.2–0.3%.

Nb (Niobium)

Like V, niobium combines with C, N to form fine precipitates such as Nb(C,N), which are effective to improve creep strength. Nb is effective to improve creep strength in a short period. When it is added excessively, the thus formed Nb(C,N) easily grows coarse and impairs creep strength. Furthermore, niobium which is present as precipitates is effective to prevent the fine crystal grains of austenite from coarsening during normalizing treatment, thus markedly improving the toughness.

When the Nb content is less than 0.01%, the intended effect cannot be obtained. When the Nb content is over 0.3%, or sometimes when it is over 0.2%, even after normalizing a relatively large amount of precipitates remains, and strength is deteriorated. Thus, the Nb content is defined as 0.01–0.3%, or 0.01–0.2%, and preferably 0.1% or less. A more preferred Nb content is about 0.05%.

Furthermore, according to the present invention, the minor amounts of the following elements may also be incorporated.

B (Boron)

The addition of boron in a minor amount is effective to uniformly distribute and stabilize carbides. However, when the boron content is 0.001% or less, the intended effect cannot be expected. On the other hand, when the boron content is over 0.02%, the weldability is impaired. Thus, when B is added, its content is restricted to 0.001–0.02% by weight.

Ca, Ti, Zr, Y, La, Ce

These elements are added in a small amount so as to control the shape of inclusions. When at least one of these elements is added in an amount of 0.01% or more, impurities such as oxygen, phosphorus, and sulfur are excluded to improve strength as well as toughness. However, it is added in an amount of more than 0.2%, the amount of inclusions increases, and the toughness is rather impaired. Therefore, according to the present invention, the content of these elements, when added, is restricted to 0.01–0.2%.

In one embodiment of the present invention, a steel having the composition defined above is successfully subjected to high-temperature tempering after normalizing to further improve the high-temperature, long-term creep strength.

In the case of a steel containing V and/or Nb, for example, the martensite formed after normalizing is subjected to tempering, while fine carbo-, nitrides of V and/or Nb are precipitated, greatly suppressing recovery of dislocations. Therefore, the metallurgical structure becomes unstable at elevated temperatures if the tempering temperature is relatively low. Namely, a V- and/or Nb-containing steel is highly resistant to softening after tempering. When the tempering is carried out at a temperature which is lower than 800° C., the martensite phase is recrystallized during high-temperature use at 600° C. or higher, markedly decreasing the strength. In contrast, when the tempering is carried out at a high temperature of 810° C. or higher, the martensite is well stabilized and the recrystallization during high-temperature use is successfully suppressed to achieve improved high-temperature properties, e.g. the steel can be used at 600° C. or higher for $10^5$ hours or more.

The present invention will be further described in conjunction with the following working examples, which are presented merely for the purpose of further illustrating the present invention, and the present invention is not restricted thereby in any way.

EXAMPLE 1

The steels having the chemical compositions shown in Table 1 were melted in a vacuum induction furnace to prepare 50 Kg ingots. The ingots were then forged at 1150°–950° C. to form plates of steel 20 mm thick. The plates were subjected to the heat treatment indicated in Table 2. After heat treatment, a creep and tensile test was applied to the test pieces (6 mmϕ×GL 30 mm) were cut from the center portion of the plate thickness. The test results are summarized in Table 2.

For Steel J of Table 1, creep rupture tests were carried out at 600° C. and 650° C.

The test results are graphically summarized in FIG. 1. A comparative tempered steel exhibits a relatively high strength for up to $10^3$ hours. However, after $10^4$ hours the strength decreases rapidly for the comparative tempered steel. According to the present invention, a stable level of strength can be obtained even after $10^4$ hours. When tested at 600° C., the strength of the steel of the present invention exceeds that of the comparative tempered steel after $10^4$ hours have elapsed. When tested at 650° C., after 5000 hours have elapsed the present invention is superior to the comparative steel.

It is also noted from FIG. 1 that according to the conventional heat treatment, the creep rupture strength at 600° C. extrapolated to $10^5$ hours is 6.2 kgf/mm$^2$, and that according to the heat treatment of the present invention the creep rupture strength reaches 9.1 kgf/mm$^2$. Furthermore, at a temperature of 650° C. the creep rupture strength extrapolated to $10^5$ hours is 4.5 kgf/mm$^2$ for the present invention, and 2.9 kgf/mm$^2$ for the comparative one.

Figure 2:
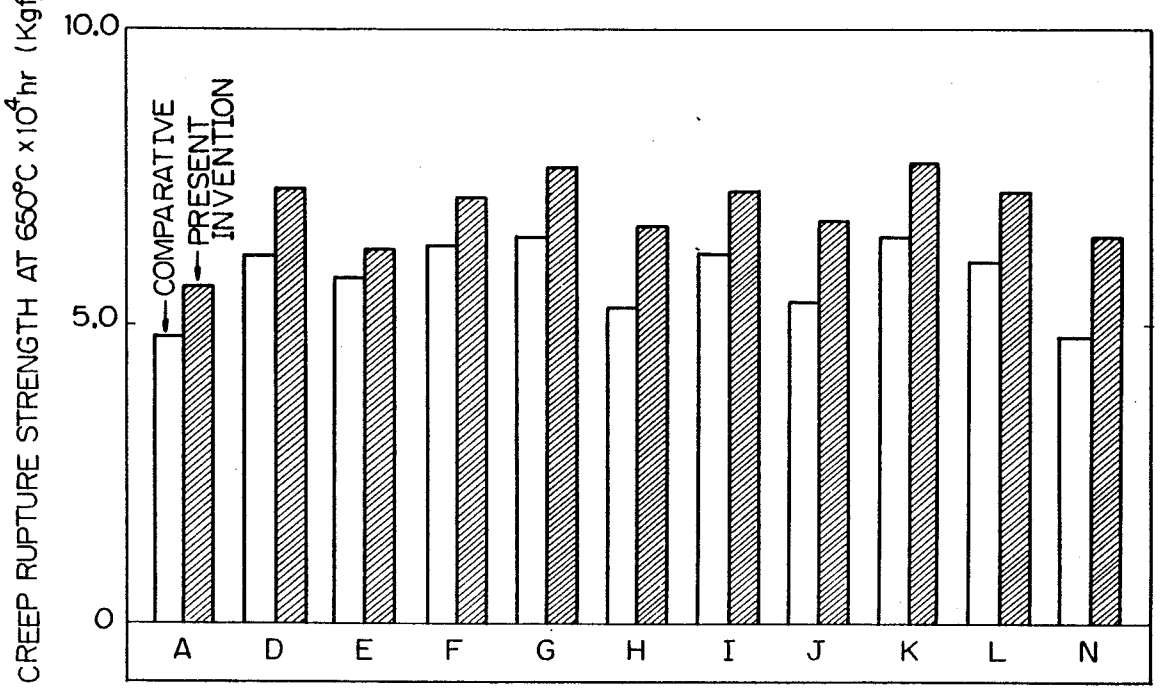
FIG. 2 is a graph which shows the effectiveness of the heat treatment of the present invention for improving high-temperature strength.

FIG. 2 is a graph which illustrates the test results of Table 2. The hatched bars indicate creep rupture strength for the present invention while the unhatched bars indicate the values for samples of steel having the same compositions but which were not heat treated in accordance with the present invention. For each of the steels the heat treatment of the present invention resulted in a substantial improvement in creep strength at 650° C. for $10^4$ hours.

Thus, it is apparent from FIG. 2 that the heat treatment defined by the present invention is effective to further improve the creep strength.

EXAMPLE 2

In this example, Example 1 was repeated using steels having the chemical compositions shown in Table 3.

Steels A and B of Table 3 were subjected to normalizing heat treatment by applying heat at 950° C. for 1 hour followed by air cooling, and then tempering was carried out by heating at 750° C. for 1 hour followed by air cooling.

For Steels C, D, E, and F of Table 3, which contained V and Nb, normalizing of 1050° C.×1 hr+ AC (air cooling) and tempering of 780° C.×1 hr+ AC were employed.

For Steels G–Z of Table 3, normalizing of 1050° C.×1 hr+AC and tempering of 810°–830° C.×0.5 hr+AC was employed.

The test results are summarized in Table 4. The mechanical properties of the steels are also shown.

Figure 3:
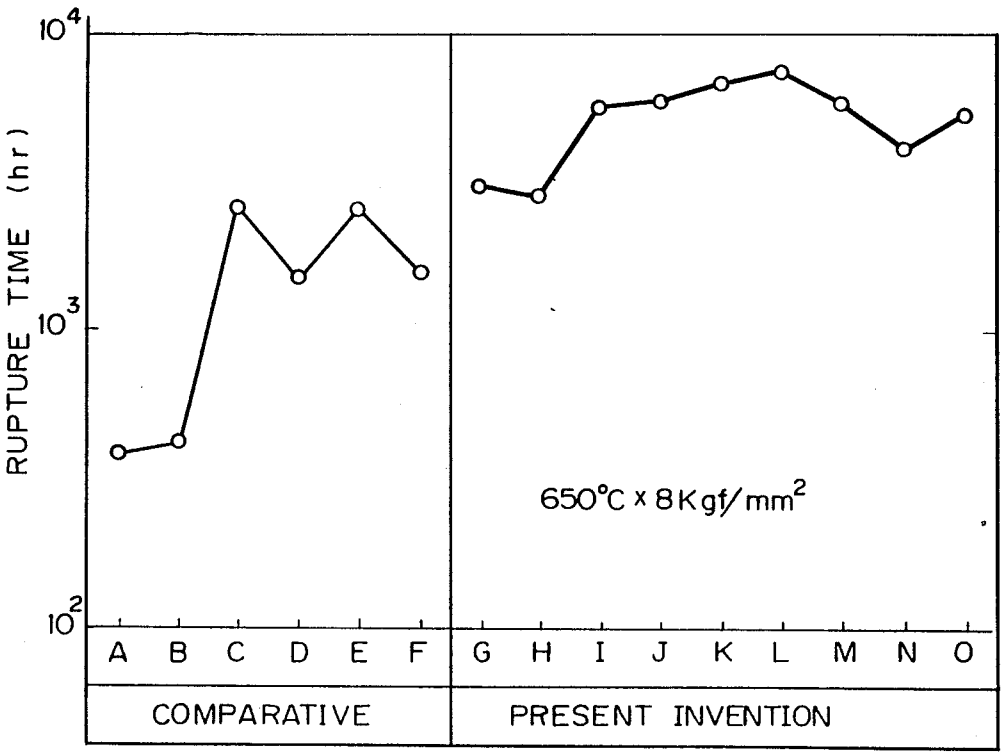
FIG. 3 is a graph showing the resistance to rupture at 650° C. under 8 kgf/mm$^2$.

FIG. 3 is a graph showing creep rupture time under 650° C.×8 kgf/mm$^2$, the data being taken from Table 4.

Figure 4:
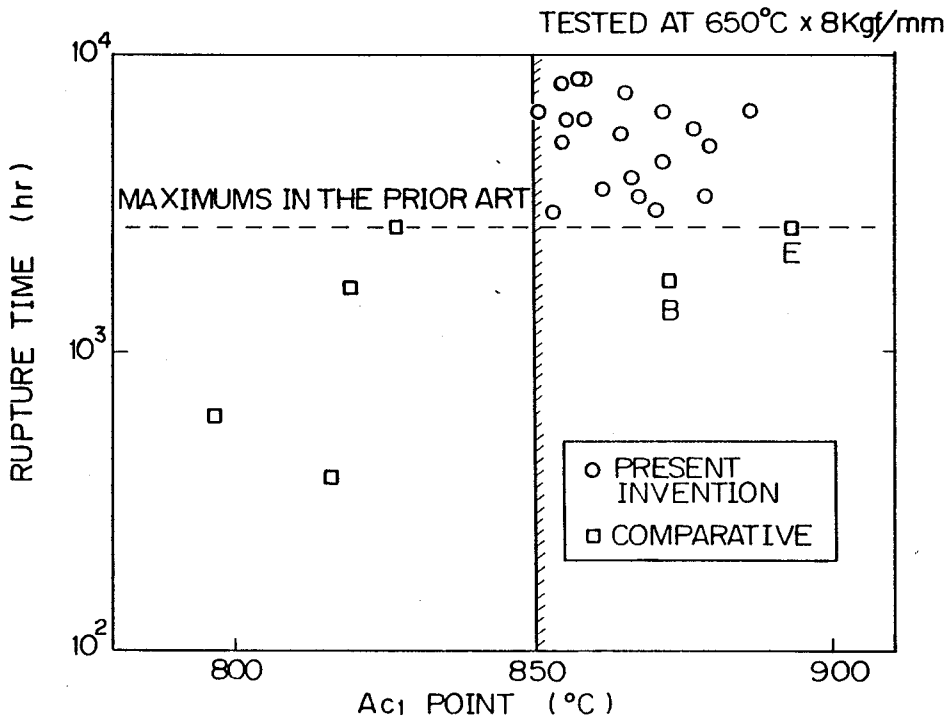
FIG. 4 is a graph illustrating the critical meaning of the $A_{c1}$ point defined in the present invention.

FIG. 4 is also a graph summarizing the data given in Table 4 in a different way. The criticality of the $A_{c1}$ point is apparent therefrom. The steels of the present invention exceed the desired level for high-temperature, long-term creep strength.

Thus, a high-Cr ferritic steel according to the present invention can exhibit much improved high-temperature, long-term creep strength. In addition, the steel can exhibit satisfactory high-temperature strength under 650° C.×8 kgf/mm$^2$ for over 2600 hours.

Furthermore, since the $A_{c1}$ point is 820° C. or higher, and usually 850° C. or higher according to the present invention, the following advantages can be obtained:

(1) It is possible to carry out high-temperature tempering at 800° C. or higher, and usually 810° C. or higher. Therefore, the metallurgical structure and strength of the resulting steel are stable when used at elevated temperatures, e.g., 600° C. or higher.

(2) The period of time required for performing tempering can be shortened. In the prior art, over one hour of treatment is required. However, according to the present invention, 30 minutes are enough.

(3) It is possible to carry out hot working at elevated temperatures, such as about 830° C. without transformation. It is also possible to eliminate stress-relieving annealing, since the $A_{c1}$ point is high.

(4) Unexpectedly, the strength at room temperature of the high-Cr ferritic steel of the present invention is rather low, and the ductility thereof is rather high. Therefore, forming at room temperature, especially bending at room temperature is quite easy.

TABLE 1

| Steel | C | Si | Mn | P | S | Ni | Cr | Mo | W | V | Nb | sol.Al | N | Acl (°C.) |
|---|---|---|---|---|---|---|---|---|---|---|---|---|---|---|
| A | 0.11 | 0.38 | 0.48 | 0.012 | 0.005 | 0.35 | 7.25 | 2.32 | 1.05 | 0.32 | 0.04 | 0.011 | 0.041 | 851 |
| B* | 0.13 | 0.45 | 0.55 | 0.016 | 0.004 | — | 9.02 | — | — | — | — | 0.001 | 0.002 | 798 |
| C* | 0.09 | 0.55 | 0.62 | 0.012 | 0.007 | 0.12 | 9.11 | 1.05 | — | — | — | 0.002 | 0.015 | 837 |
| D | 0.06 | 0.48 | 0.52 | 0.011 | 0.009 | 0.15 | 9.32 | 2.04 | — | 0.28 | 0.05 | 0.007 | 0.051 | 878 |
| E | 0.08 | 0.35 | 0.65 | 0.009 | 0.003 | 0.25 | 9.05 | 1.51 | — | 0.21 | 0.08 | 0.012 | 0.048 | 840 |
| F | 0.07 | 0.32 | 0.65 | 0.012 | 0.007 | 0.16 | 9.02 | 0.05 | 2.75 | 0.15 | 0.03 | 0.011 | 0.045 | 848 |
| G | 0.06 | 0.42 | 0.55 | 0.005 | 0.003 | 0.25 | 8.85 | 1.03 | 1.05 | 0.18 | 0.02 | 0.005 | 0.052 | 851 |
| H | 0.07 | 0.45 | 0.52 | 0.008 | 0.002 | 0.08 | 9.08 | 1.21 | 1.06 | — | 0.21 | 0.005 | 0.015 | 874 |
| I | 0.08 | 0.21 | 0.37 | 0.009 | 0.005 | 0.09 | 8.57 | 1.02 | 1.06 | 0.15 | — | 0.007 | 0.048 | 841 |
| J | 0.11 | 0.21 | 0.55 | 0.012 | 0.005 | 0.15 | 12.13 | 1.03 | 1.02 | 0.22 | 0.21 | 0.008 | 0.022 | 880 |
| K | 0.10 | 0.23 | 0.52 | 0.014 | 0.004 | 0.31 | 12.58 | 1.17 | 1.18 | 0.28 | 0.03 | 0.007 | 0.045 | 880 |
| L | 0.12 | 0.32 | 0.62 | 0.013 | 0.007 | 0.40 | 12.23 | 0.92 | 0.85 | 0.25 | — | 0.005 | 0.048 | 848 |
| M* | 0.21 | 0.35 | 0.65 | 0.015 | 0.006 | 0.35 | 12.01 | 1.05 | 0.47 | 0.31 | — | 0.002 | 0.036 | 809 |
| N | 0.15 | 0.32 | 0.47 | 0.012 | 0.006 | 0.45 | 13.75 | 0.75 | 1.08 | 0.35 | — | 0.006 | 0.062 | 850 |

NOTE:
*Comparative
Acl (°C.) = 765 − 500C − 450N + 30Si − 25Mn − 30Ni + 11Cr + 25Mo + 15W + 50V + 30Nb + 30sol.Al (% by weight)

TABLE 2

| Steel | Conventional heat treatment | Creep rupture strength at 650° C. × $10^4$ hr (kgf/mm$^2$) | Present invention heat treatment | Creep rupture strength at 650° C. × $10^4$ hr (kgf/mm$^2$) |
|---|---|---|---|---|
| A | 950° C. × 1 hAc + 750° C. × 1 hAc | 4.8 | 950° C. × 1 hAc + 815° C. × 0.5 hAc | 5.7 |
| B* | " | 3.8 | — | — |
| C* | " | 4.5 | — | — |
| D | 1040° C. × 1 hAc + 760° C. × 1 hAc | 6.2 | 1040° C. × 1 hAc + 815° C. × 0.5 hAc | 7.3 |
| E | " | 5.8 | " | 6.8 |
| F | " | 6.4 | " | 7.2 |
| G | " | 6.5 | " | 7.7 |
| H | " | 5.3 | " | 6.7 |
| I | " | 6.2 | " | 7.3 |
| J | 1050° C. × 1 hAc + 760° C. × 1 hAc | 5.4 | 1050° C. × 1 hAc + 820° C. × 1 hAc | 6.8 |
| K | " | 6.5 | " | 7.8 |
| L | " | 6.1 | " | 7.3 |
| M* | " | 5.3 | — | — |
| N | 1050° C. × 1 hAc + 740° C. × 1 hAc | 4.8 | 1050° C. × 1 hAc + 830° C. × 1 hAc | 6.5 |

NOTE: *Comparative

TABLE 3

| | Steel | C | Si | Mn | P | S | Ni | Cr | Mo | W | V | Nb | sol. Al | N | (% by weight) Others |
|---|---|---|---|---|---|---|---|---|---|---|---|---|---|---|---|
| Comparative | A | 0.12 | 0.59 | 0.44 | 0.015 | 0.003 | 0.14 | 8.58 | 1.03 | — | — | — | 0.005 | 0.026 | |
| | B | 0.07 | 0.36 | 0.53 | 0.012 | 0.005 | 0.13 | 9.31 | 2.13 | — | — | — | 0.012 | 0.014 | |
| | C | 0.10 | 0.36 | 0.41 | 0.013 | 0.005 | 0.07 | 8.37 | 0.98 | — | 0.28 | 0.08 | 0.013 | 0.045 | |
| | D | 0.20 | 0.25 | 0.52 | 0.005 | 0.006 | 0.52 | 11.92 | 0.91 | — | 0.32 | — | 0.008 | 0.041 | |
| | E | 0.13 | 0.48 | 0.35 | 0.010 | 0.004 | 0.21 | 13.05 | 1.20 | 0.85 | 0.25 | 0.05 | 0.021 | 0.015 | |
| | F | 0.22 | 0.35 | 0.45 | 0.011 | 0.006 | 0.15 | 12.01 | 1.02 | 0.60 | 0.35 | — | 0.021 | 0.035 | |
| Present invention | G | 0.07 | 0.10 | 0.55 | 0.008 | 0.003 | 0.35 | 9.58 | 2.08 | 0.52 | 0.25 | 0.06 | 0.021 | 0.021 | |
| | H | 0.06 | 0.15 | 0.48 | 0.010 | 0.007 | 0.25 | 9.20 | 0.53 | 2.03 | 0.26 | 0.12 | 0.012 | 0.025 | |
| | I | 0.09 | 0.21 | 0.35 | 0.011 | 0.008 | 0.10 | 9.10 | 1.03 | 1.02 | 0.21 | 0.06 | 0.008 | 0.027 | |
| | J | 0.06 | 0.22 | 0.53 | 0.014 | 0.005 | 0.35 | 11.87 | 1.02 | 1.05 | 0.23 | 0.08 | 0.015 | 0.035 | |
| | K | 0.10 | 0.31 | 0.55 | 0.009 | 0.006 | 0.29 | 12.03 | 1.08 | 0.85 | 0.21 | 0.04 | 0.012 | 0.045 | |
| | L | 0.12 | 0.15 | 0.51 | 0.012 | 0.004 | 0.25 | 12.51 | 1.07 | 1.02 | 0.25 | 0.05 | 0.011 | 0.055 | |
| | M | 0.13 | 0.12 | 0.65 | 0.008 | 0.005 | 0.55 | 11.74 | 2.02 | 1.05 | 0.21 | 0.02 | 0.010 | 0.060 | |
| | N | 0.12 | 0.25 | 0.45 | 0.010 | 0.007 | 0.37 | 11.54 | 1.02 | 2.03 | 0.15 | 0.03 | 0.013 | 0.021 | B: 0.0010<br>Ca: 0.10<br>La + Ce: 0.15 |
| | O | 0.11 | 0.07 | 0.55 | 0.011 | 0.004 | 0.35 | 12.14 | 1.08 | 0.95 | 0.21 | 0.09 | 0.012 | 0.035 | |
| | P | 0.06 | 0.02 | 0.25 | 0.005 | 0.002 | 0.35 | 11.02 | 1.00 | 0.78 | 0.21 | 0.08 | 0.007 | 0.055 | B: 0.015 |
| | Q | 0.14 | 0.05 | 0.30 | 0.011 | 0.007 | 0.01 | 12.74 | 0.55 | 2.89 | 0.35 | 0.12 | 0.013 | 0.060 | Ca: 0.15 |
| | R | 0.08 | 0.12 | 0.35 | 0.003 | 0.003 | 0.02 | 8.72 | 0.63 | 2.75 | 0.15 | 0.11 | 0.009 | 0.035 | Ti: 0.05 |
| | S | 0.09 | 0.15 | 0.32 | 0.012 | 0.004 | 0.09 | 9.03 | 1.52 | 0.75 | 0.13 | 0.10 | 0.011 | 0.042 | Zr: 0.18 |
| | T | 0.14 | 0.25 | 0.37 | 0.009 | 0.003 | 0.01 | 9.07 | 2.72 | 0.62 | 0.15 | 0.03 | 0.011 | 0.038 | Y: 0.19 |
| | U | 0.11 | 0.11 | 0.37 | 0.008 | 0.003 | 0.32 | 11.92 | 1.02 | 1.58 | 0.23 | 0.07 | 0.007 | 0.065 | La: 0.05 |
| | V | 0.10 | 0.25 | 0.23 | 0.009 | 0.002 | 0.21 | 11.79 | 1.11 | 1.03 | 0.22 | 0.05 | 0.008 | 0.037 | Ce: 0.10 |
| | W | 0.10 | 0.11 | 0.55 | 0.012 | 0.001 | 0.25 | 12.02 | 0.98 | 0.87 | 0.20 | 0.06 | 0.009 | 0.053 | B: 0.005, Ca: 0.20 |
| | X | 0.06 | 0.32 | 0.58 | 0.011 | 0.003 | 0.11 | 9.53 | 1.21 | 0.75 | 0.15 | 0.05 | 0.011 | 0.061 | B: 0.008, Zr: 0.12 |
| | Y | 0.07 | 0.28 | 0.60 | 0.009 | 0.004 | 0.55 | 12.11 | 1.03 | 1.01 | 0.25 | 0.07 | 0.012 | 0.055 | Y: 0.10, Ti: 0.10 |
| | Z | 0.09 | 0.28 | 0.65 | 0.005 | 0.005 | 0.35 | 11.85 | 1.32 | 0.52 | 0.25 | 0.06 | 0.009 | 0.042 | B: 0.003, Ti: 0.05<br>Y: 0.12, La: 0.13 |

TABLE 4

| | Steel | [1]Acl (°C.) | [2]Cr equivalent | Tensile test at room temp. T.S.* (kgf/mm²) | 0.2% Y.S.* (kgf/mm²) | El.* (%) | D.R.* (%) | Tensile test at 650° C. T.S.* (kgf/mm²) | 0.2% Y.S.* (kgf/mm²) | El.* (%) | D.R.* (%) | [3]Creep rupture time (hr) |
|---|---|---|---|---|---|---|---|---|---|---|---|---|
| Comparative | A | 816 | 9.3 | 79.2 | 59.9 | 22.7 | 71.6 | 28.6 | 22.3 | 47.7 | 94.6 | 380.1 |
| | B | 873 | 15.3 | 66.4 | 50.1 | 24.5 | 72.0 | 24.2 | 18.8 | 48.3 | 92.3 | 420.5 |
| | C | 827 | 11.6 | 67.6 | 50.4 | 24.6 | 75.0 | 31.1 | 20.6 | 35.3 | 86.5 | 2617.1 |
| | D | 796 | 8.3 | 76.1 | 54.5 | 21.8 | 61.0 | 30.5 | 21.6 | 34.2 | 85.8 | 1525.6 |
| | E | 894 | 18.0 | 75.1 | 56.2 | 21.3 | 57.8 | 31.4 | 22.8 | 30.3 | 88.9 | 2575.0 |
| | F | 819 | 11.8 | 76.3 | 53.5 | 24.3 | 63.5 | 29.3 | 21.5 | 33.6 | 87.8 | 1627.5 |
| Present invention | G | 879 | 16.7 | 63.5 | 41.6 | 28.6 | 71.6 | 23.9 | 18.5 | 47.3 | 93.8 | 3217.5 |
| | H | 871 | 13.8 | 62.1 | 40.9 | 29.3 | 72.6 | 24.2 | 17.8 | 49.6 | 92.8 | 2895.2 |
| | I | 856 | 13.2 | 64.3 | 42.3 | 27.7 | 71.0 | 24.8 | 18.6 | 52.0 | 91.6 | 5946.1 |
| | J | 887 | 16.0 | 65.5 | 43.1 | 27.3 | 71.6 | 24.5 | 19.5 | 51.0 | 92.0 | 6344.9 |
| | K | 866 | 14.5 | 65.1 | 42.9 | 28.0 | 71.0 | 25.9 | 20.5 | 47.3 | 93.8 | 7455.6 |
| | L | 858 | 13.9 | 67.3 | 45.8 | 25.3 | 69.2 | 26.3 | 21.3 | 45.2 | 91.5 | 8119.4 |
| | M | 851 | 14.1 | 72.0 | 51.2 | 23.5 | 63.2 | 30.2 | 24.1 | 44.7 | 88.6 | 6218.1 |
| | N | 872 | 14.3 | 71.9 | 47.2 | 24.7 | 64.0 | 29.0 | 20.4 | 50.3 | 89.5 | 4271.6 |
| | O | 860 | 13.3 | 69.8 | 50.3 | 28.4 | 70.5 | 30.4 | 24.5 | 45.8 | 88.7 | 5726.8 |
| | P | 865 | 13.2 | 72.3 | 51.1 | 22.5 | 63.5 | 31.2 | 21.2 | 47.8 | 92.1 | 5275.3 |
| | Q | 880 | 16.1 | 70.3 | 50.3 | 21.5 | 67.8 | 30.1 | 20.3 | 44.5 | 87.5 | 4872.3 |
| | R | 867 | 13.4 | 64.2 | 43.3 | 23.2 | 69.2 | 27.5 | 19.3 | 46.2 | 89.2 | 3785.0 |
| | S | 853 | 13.3 | 63.5 | 43.5 | 25.5 | 72.5 | 24.8 | 17.9 | 45.3 | 93.8 | 2972.4 |
| | T | 862 | 16.8 | 62.7 | 40.3 | 27.2 | 73.4 | 27.2 | 17.8 | 47.2 | 92.5 | 3562.7 |
| | U | 869 | 13.6 | 73.5 | 52.5 | 21.0 | 61.7 | 32.1 | 24.3 | 42.3 | 91.5 | 8215.6 |
| | V | 877 | 15.5 | 67.2 | 45.5 | 28.5 | 65.8 | 27.8 | 20.5 | 48.5 | 93.2 | 5627.3 |
| | W | 855 | 12.8 | 63.2 | 41.2 | 25.2 | 67.2 | 25.5 | 19.5 | 47.2 | 92.3 | 4824.0 |
| | X | 855 | 13.6 | 62.1 | 41.8 | 21.5 | 75.3 | 27.6 | 17.9 | 43.2 | 90.3 | 7829.4 |
| | Y | 871 | 14.8 | 65.5 | 43.7 | 26.3 | 62.3 | 26.9 | 18.2 | 47.5 | 91.5 | 6213.5 |
| | Z | 868 | 15.2 | 67.5 | 50.2 | 28.0 | 67.8 | 27.2 | 19.8 | 46.2 | 93.2 | 3256.4 |

NOTE:
[1]Acl (°C.) = 765 − 500C − 450N + 30Si − 25Mn + 25Mo + 15W + 11Cr + 50V + 30Nb − 30Ni + 30sol.Al (% by weight)
[2]Cr equivalent = Cr − 40C − 30N + 6Si − 2Mn + 4Mo + 1.5W + 11V + 5Nb − 12Sol.Al (% by weight)
[3]650° C. × 8 kgf/mm²
*T.S.: Tensile Strength,
Y.S.: Yield Strength,
El.: Elongation,
D.R.: Drawing Ratio

What is claimed is:

1. A high-strength high-Cr ferritic, heat-resistant steel exhibiting improved high-temperature, long-term creep strength which corresponds to a creep rupture time of at least 2600 hrs., measured in an accelerated creep test carried out at conditions of 650° C.×8 kgf/mm², which consists essentially of, by weight %:

| | |
|---|---|
| C: 0.05–0.15%, | Si: not more than 1.0%, |
| Mn: 0.2–1.0%, | P: not more than 0.025%, |
| S: not more than 0.015%, | Ni: not more than 0.8%, |
| Cr: 8.0–13%, | Mo: 0.5–3%, |
| W: 0.5–3.0%, | sol. Al: 0.005–0.04%, |
| N: 0.02–0.07%, | V: 0.1–0.4%, |
| Nb: 0.01–0.05%, | |
| B: 0–0.02%, | |

at least one of Ca, Ti, Zr, Y, La, and Ce each in an amount of : 0–0.2%, and the balance Fe and incidental impurities, the $A_{c1}$ point defined by Formula (1) below being 850° C. or higher, and the Cr-equivalent defined by Formula (2) below being 17 or less.

$$A_{c1}\ (°C.) = 765 - 500C - 450N + 30Si - 25Mn + 25Mo + 15W + 11Cr + 50V + 30Nb - 30Ni + 30\ \text{sol. Al(weight \%)} \quad (1)$$

$$\text{Cr-equivalent} = Cr - 40C - 30N + 6Si - 2Mn + 4Mo + 1.5W + 11V + 5Nb - 4Ni + 12\ \text{soln. Al.} \quad (2)$$

2. A high-strength high-Cr ferritic, heat-resistant steel as defined in claim 1, in which

B : 0.001–0.02%.

3. A high-strength high-Cr ferritic, heat-resistant steel as defined in claim 1 in which said at least one of Ca, Ti, Zr, Y, La, and Ce is each present in an amount of : 0.01–0.2%.

* * * * *

UNITED STATES PATENT AND TRADEMARK OFFICE

CERTIFICATE OF CORRECTION

PATENT NO. : 4,957,701

DATED : September 18, 1990

INVENTOR(S) : Fujimitsu Masuyama, et al.

It is certified that error appears in the above-identified patent and that said Letters Patent is hereby corrected as shown below:

ON TITLE PAGE:

[54] The following words are added to the title:

--AND PROCESS FOR PRODUCING THE SAME--

Signed and Sealed this

Third Day of December, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,957,701

DATED : September 18, 1990

INVENTOR(S) : Fujimitsu Masuyama, et al.

It is certified that error appears in the above-identified patent and that said Letters Patent is hereby corrected as shown below:

Title page fourth inventor's name is changed to:

(75) Kunihiko Yoshikawa

Signed and Sealed this

Twenty-eighth Day of January, 1992

*Attest:*

HARRY F. MANBECK, JR.

*Attesting Officer*

*Commissioner of Patents and Trademarks*